US006694850B1

(12) United States Patent
Tosatto

(10) Patent No.: US 6,694,850 B1
(45) Date of Patent: Feb. 24, 2004

(54) CUTTER FOR CROSS CUTTING OF REELED WEBS

(75) Inventor: Giacomo Tosatto, Turin (IT)

(73) Assignee: Temco SRL (IT)

( * ) Notice: Subject to any disclaimer, the term of this patent is extended or adjusted under 35 U.S.C. 154(b) by 0 days.

(21) Appl. No.: 09/428,966

(22) Filed: Nov. 4, 1999

(30) Foreign Application Priority Data

Nov. 6, 1998 (EP) ..... 98830671

(51) Int. Cl.[7] ..... B26D 1/62; B26D 5/02

(52) U.S. Cl. ..... 83/337; 83/343; 83/345; 83/354; 83/355; 83/588; 83/646; 83/650; 74/431; 74/567; 101/226

(58) Field of Search ..... 83/304, 305, 646, 83/647.5, 343, 345, 350, 355, 588, 589, 601, 602, 337, 344, 346, 347, 348, 354, 356.2, 249, 650; 101/92, 224, 226, 248; 74/396, 411, 431, 437, 439, 460, 461, 462, 567; 400/621

(56) References Cited

U.S. PATENT DOCUMENTS

| | | | | | |
|---|---|---|---|---|---|
| 641,216 | A | * | 1/1900 | Meisel | 101/224 X |
| 1,289,084 | A | * | 12/1918 | Banzett | 101/226 X |
| 1,876,838 | A | * | 9/1932 | Biggert, Jr. | 83/304 |
| 1,984,913 | A | * | 12/1934 | Biggert, Jr. | 83/305 X |
| 2,076,969 | A | * | 4/1937 | Sieger | 83/305 X |
| 2,482,118 | A | * | 9/1949 | Matthews | 83/305 |
| 4,080,856 | A | * | 3/1978 | Shearon | 83/345 X |
| 4,226,149 | A | * | 10/1980 | Feldkamper et al. | 83/305 |

* cited by examiner

*Primary Examiner*—Clark F. Dexter
(74) *Attorney, Agent, or Firm*—Cantor Colburn LLP

(57) ABSTRACT

Cutter for cross cutting of reeled webs comprising a rotary cutting assembly including a blade and a counter blade rotated in synchronism with an advancement assembly of the web. The rotation axes of the blade and of the counter blade are displaceable relative to each other, perpendicularly to the web, and a gear actuator is provided to operate mutual approaching thereof when the blade and the counter blade are placed in a mutually facing angular position for cutting the web. The blade and the counter blade are rotated only at the time of cutting.

11 Claims, 6 Drawing Sheets

CUTTER FOR CROSS CUTTING OF REELED WEBS

BACKGROUND OF THE INVENTION

The present invention is related to cutters for cross cutting of reeled webs, and more particularly of paper, aluminium, coupled paper-aluminium and the like webs.

In the field of such web cutters three different systems are presently known. A first system consist of a vertically displacable guillotine knife whose down stroke across the web performs severing thereof. Evidently, descent of the guillotine knife requires stopping the web advancement, whereby this systems involves an excessively long operative time. It has also been proposed to make the cutting assembly movable and to displace it along the advancement direction of the web to avoid stopping thereof upon severing. However this solution is constructively complicated and thus expensive.

A second system employs a rotary knife, constituted by a plate mounted on the generating line of a blade-carrier cylinder, co-operating with a stationary counter blade. At each revolution, the blade projecting from the cylinder encounters the stationary counter blade, grazing it so as to cut the web interposed between the blade and the counter blade. This system is affected by precision problems and above all involves imperfections along the cut edges of the web caused by the fact that the counter blade is stationary and, as a consequence, cutting involves a more or less remarkable web tearing effect.

The third system, also of a rotary type, includes a blade and a counter blade which are both rotary. More particularly, the cutters of this type comprise a web advancement assembly, a rotary cutting assembly including a blade and a counter blade arranged at opposite sides of the web advancement path and rotatable around respective rotation axes placed transversely of said advancement path, and motor driven means to operate rotation of the blade and of the counter blade around said rotation axes in synchronism with the advancement of the web and to place said blade and counter blade in a mutually facing angular position for cutting the web.

This third system, while overcoming the drawbacks linked to the previous systems, does not however enable achieving results in terms of cutting precision and production speed which would instead be desirable.

Moreover in the case of the second and of the third system the blade and possibly the counter blade are as a rule continuously rotated during advancement of the web, which involves evident limits in connection with the maximum length of the web, deriving from the maximum diameter of the blade cylinder carrier (and possibly of the counter blade cylinder carrier) which can be applied to the cutter.

SUMMARY OF THE INVENTION

The object of the present invention is to provide a cutter for cross cutting of reeled webs of the above disclosed third type, designed to achieve appreciably improved results both as far as cutting precision, repeatability and uniformity is concerned, and in connection with increased operative speed, and which moreover is not affected by any limits related to the web cutting length.

According to the invention, this object is achieved essentially by virtue of the fact that the rotation axes of the blade and of the counter blade are further displaceable relative to each other perpendicularly to the web, of the fact that actuator means are provided to operate mutual approaching between said rotation axes when said blade and said counter blade are located in correspondence of said angular cutting position, and of the fact that said blade and said counter blade are rotated only at the time of cutting.

Due to this idea of solution, web cutting carried out between the blade and the counter blade is in practice performed by a shearing action, with a precision which is same and even greater than that afforded by the guillotine systems disclosed in the above, but with an operative speed which is at least same and even greater than that of the rotary systems, without any limits to the cutting length.

This result can be achieved not only in connection with cuts perpendicular to the longitudinal edges of the web, but even as far as oblique cuts are concerned, providing a cutting assembly mounting capable to be angularly shifted relative to the web for instance between 0° and 45°.

According to a preferred embodiment of the invention, said actuator means comprise a rotary cam system operating against the action of return resilient means. Moreover in the preferred embodiment of the invention the rotation axis of the blade is movable while the rotation axis of the counter blade is stationary.

The cutter according to the invention can be advantageously employed for cutting reeled webs made of aluminium, paper, coupled paper-aluminium and the like, and can be installed in lines along with printing machines, spreading apparatus, spraying machines, coupling devices etc.

BRIEF DESCRIPTION OF THE DRAWINGS

The invention will now be disclosed in detail with reference to the accompanying drawings, in which.

DETAILED DESCRIPTION OF THE INVENTION

Figure 1:
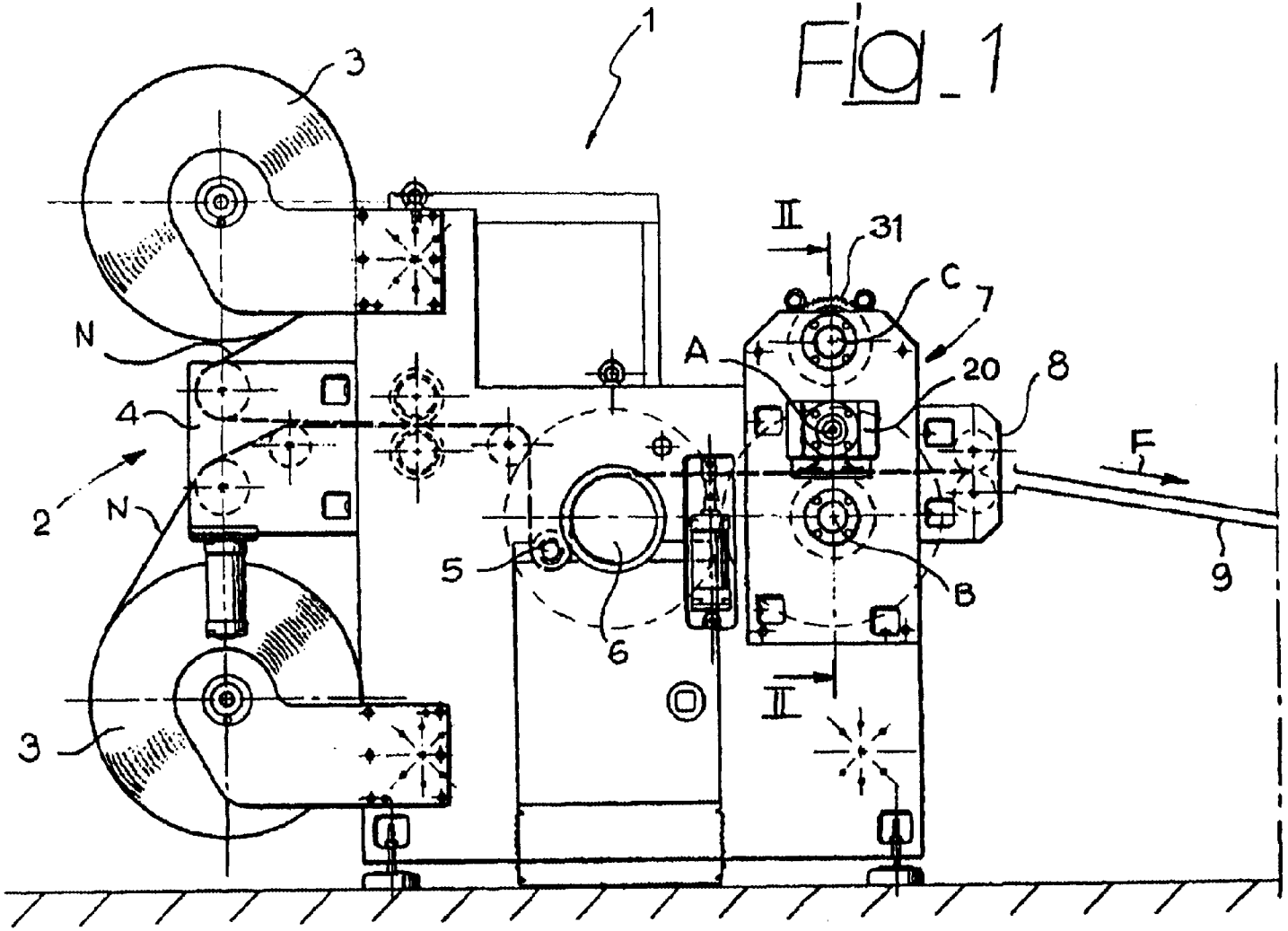
FIG. 1 is a diagrammatic lateral elevational view of a cutter for cross cutting of reeled webs according to the invention.

Referring initially to FIG. 1, reference numeral 1 generally designates a cutter according to the invention, designed to be employed in the case of the shown example for cross cutting of a web N made of aluminium. The cutter 1 comprises an unwinding station 2 including in the case of the shown example two reels 3 from which the web N, drawn through a joining unit 4 and a traction control device 5 of the web N, is unwound by a motor-driven drawing assembly 6.

Downstream of the drawing assembly 6 the web N advances along a straight horizontal path, shown by the arrow F, towards a rotary cutting assembly generally designated as 7, followed by an acceleration roller unit 8 and by a guide channel 9 of the cut sheets.

Figure 2:
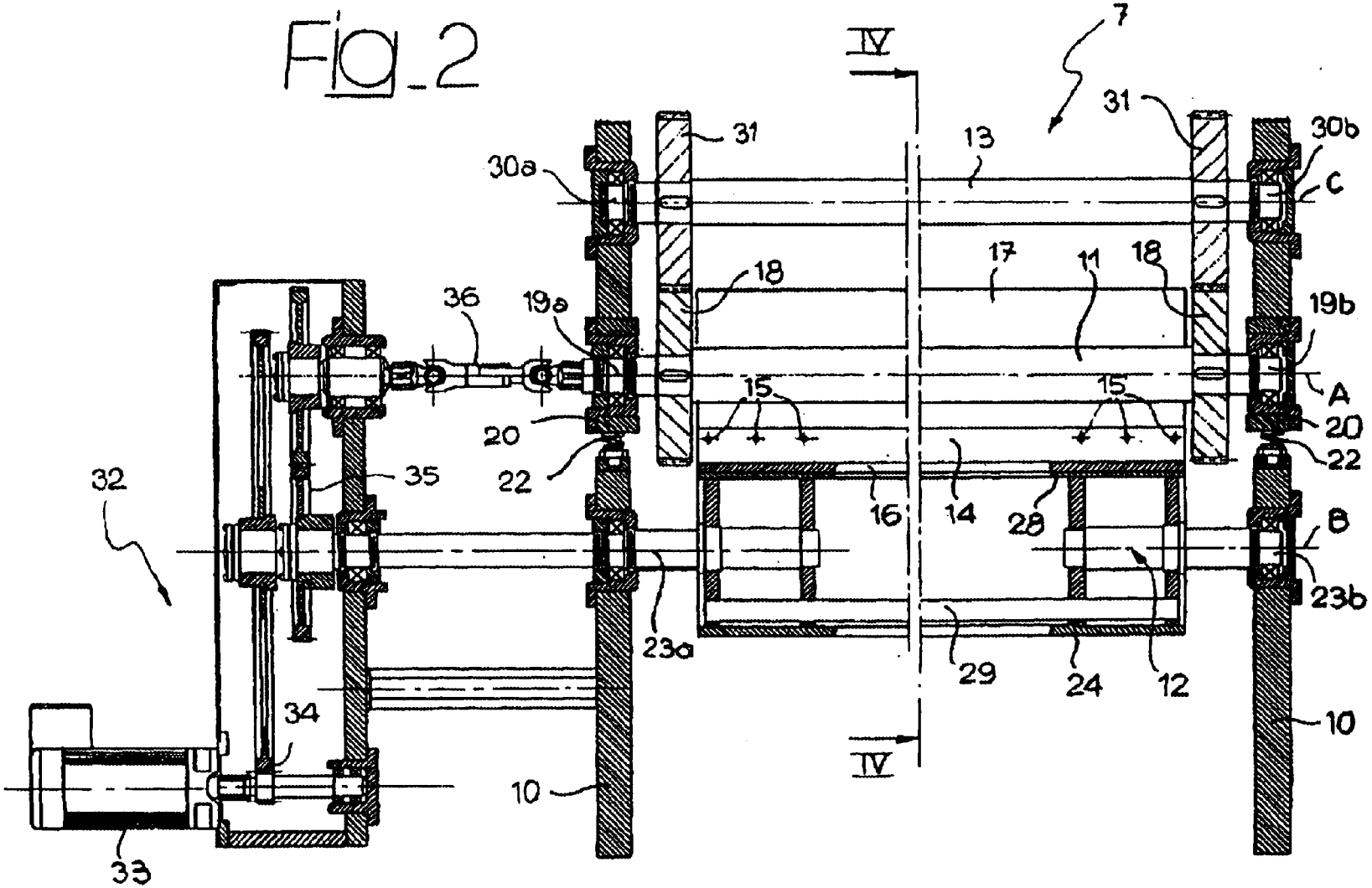
FIG. 2 is a partially cross sectioned and enlarged view along line II—II of FIG. 1.
Figure 3:
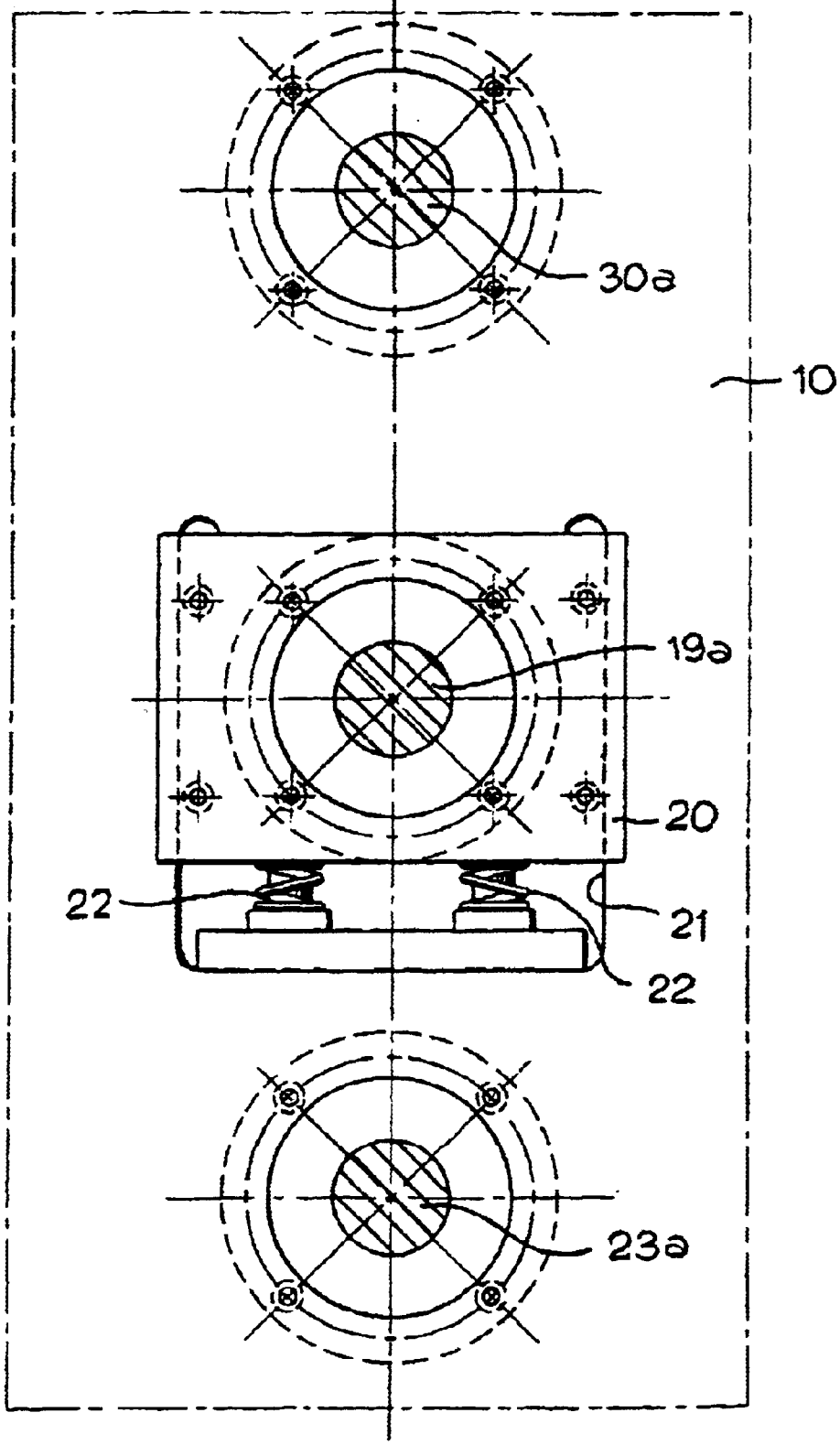
FIG. 3 shows in a larger scale a detail of FIG. 1.
Figure 4:
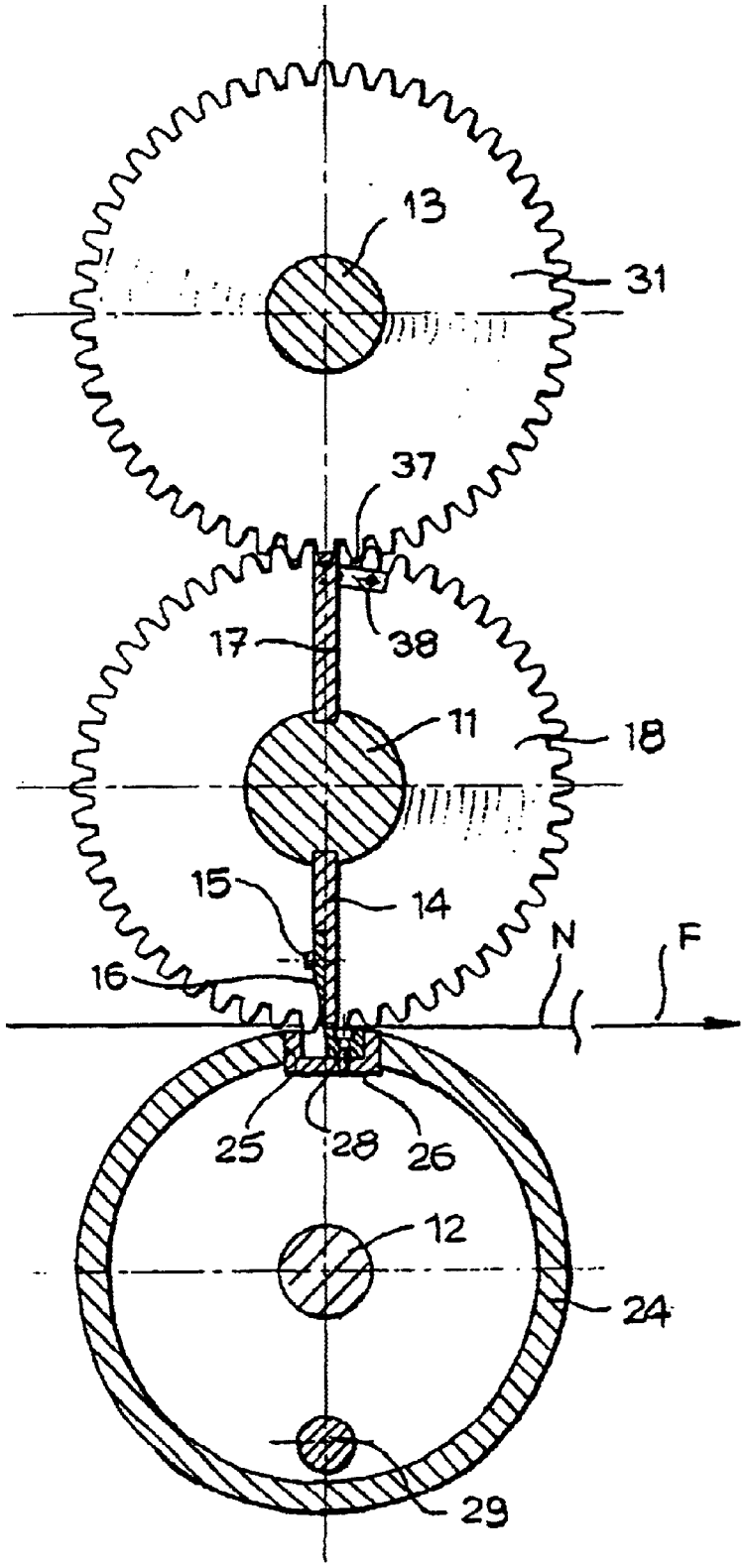
FIG. 4 is a cross sectioned and enlarged view along line IV—IV of FIG. 2.

Referring now in more detail to FIGS. 2, 3 and 4, the rotary cutting assembly 7 comprises a pair of vertical bearing walls 10 supporting for rotation a first shaft 11 rotatable around a horizontal axis A arranged above the advancement path F of the web N, a second shaft 12 rotatable around a horizontal axis B located beneath the advancement path F, and a counter shaft 13 rotatable around a horizontal axis C arranged above the axis A.

The shaft 11 carries a radially projecting and axially elongated support 14, to which a blade or knife 16 is releasably secured, for instance by means of screws 15. The conformation of the blade 16, which has a tapered cross section, can be seen in more detail in FIGS. 4 and 5.

On the diametrically opposite side to the support 14, the shaft 11 carries a counterweight 17.

Reference numerals 18 designate two cylindrical gears fixed in proximity of the ends of the shaft 11, designated as 19*a* and 19*b*. These ends 19*a*, 19*b* are rotatably mounted through respective sliding blocks 20, in turn slidably guided vertically within respective apertures 21 formed in the bearing walls 10. The sliding blocks 20, and thus the ends 91*a* and 91*b* of the shaft 11, are normally placed in a raised position shown in the drawings (and particularly in FIG. 3), and are capable to move downwardly, such as clarified herebelow, against the action of respective return springs 22. In the case of the shown example the springs 22 consist of helical compression springs: however these springs may be replaced by elastomeric material pads or the like.

Figure 5:
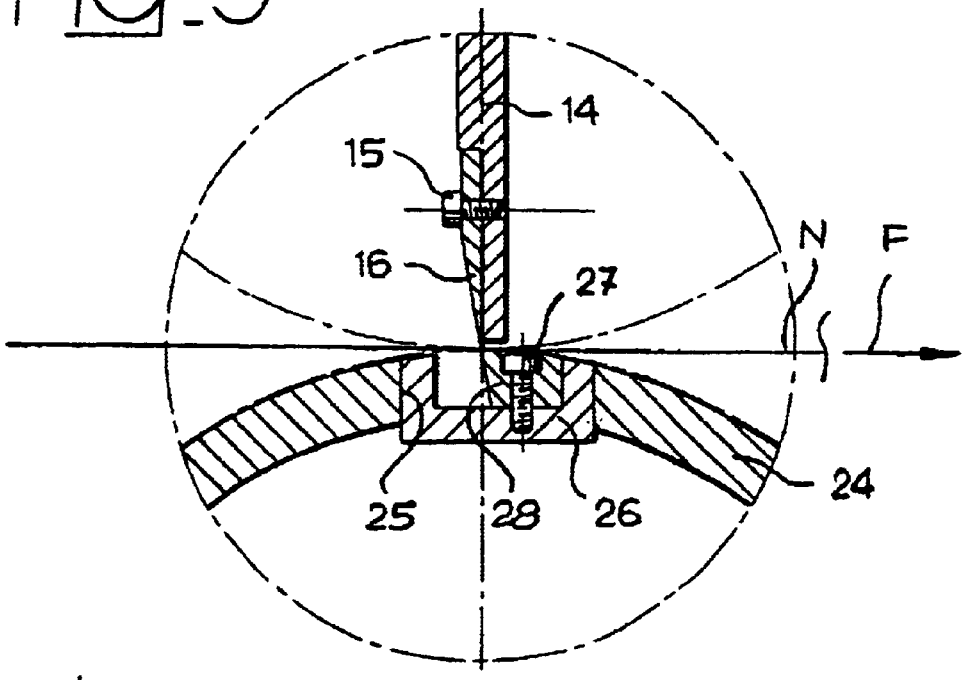
FIG. 5 shows in a larger scale a first detail of FIG. 4.
Figure 7:
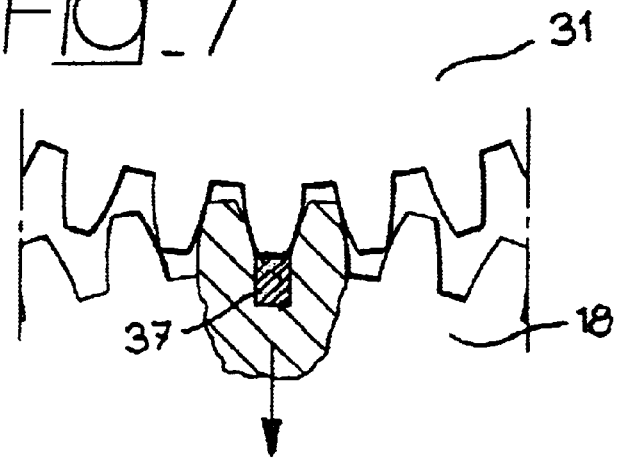
FIG. 7 is a view same as FIG. 6 in a second operating condition.

The lower shaft 12 is actually constituted by two axial shaft portions whose ends, designated as 23*a*, 23*b*, are rotatably supported by the vertical bearing walls 10. The two portions of the shaft 12 coaxially support a cylindrical jacket 24 formed with an axial slot 25 in correspondence of which a channel support 26 is fitted, to which a counter blade 28 is secured for instance by means of screws 27 (FIGS. 4 and 5). On the diametrically opposite side to the support 26 with the counter blade 28, the cylinder 24 carries an axial counterweight bar 29.

The horizontal path F of the the web N is generally tangential to the jacket 24 carried by the shaft 12. As it will be apparent in the following, this path F is never affected—namely never deflected or deviated—by the cutting operation of the web which is thus not tensioned upon cutting.

The counter shaft 13 is rotatably supported at its ends 30*a*, 30*b* by the vertical bearing walls 10 and carries, near to these ends 30*a*, 30*b*, a pair of cylindrical gears 31 whose diameter is same as the diameter of the gears 18 of the shaft 11, and meshing therewith.

Referring in more detail to FIG. 2, a driving unit generally designated as 32 is operatively associated to the rotary cutting assembly 7, which includes an electrical motor 33 conveniently of the brushless type driving in rotation, through a first gear pair 34 and a second gear pair 35, the end 23*a* of the shaft 12 of the counter blade 28, and the end 91*a* of the shaft 11 of the blade 16, respectively, via a cardanic shaft 36.

The electrical motor 33 is operated by means of an electronic control unit (not shown), in a programmable way and in synchronism with the driving motor of the drawing assembly 6, and rotates the shaft 11 and the shaft 12 not continuously, but instead in an intermittent timed way as a function of the desired cutting length of the web N, which accordingly is not subjected to any limitation.

The arrangement is such that the shaft 11 and the shaft 12 are driven in rotation by the motor 33, whenever cutting is to be performed, with same peripheral speed, whereby following each complete revolution the blade 16 and the counter blade 28 are placed in a mutually facing angular position at opposite sides of the web N, such as depicted in FIGS. 2, 4 and in better detail in FIG. 5.

Figure 8:
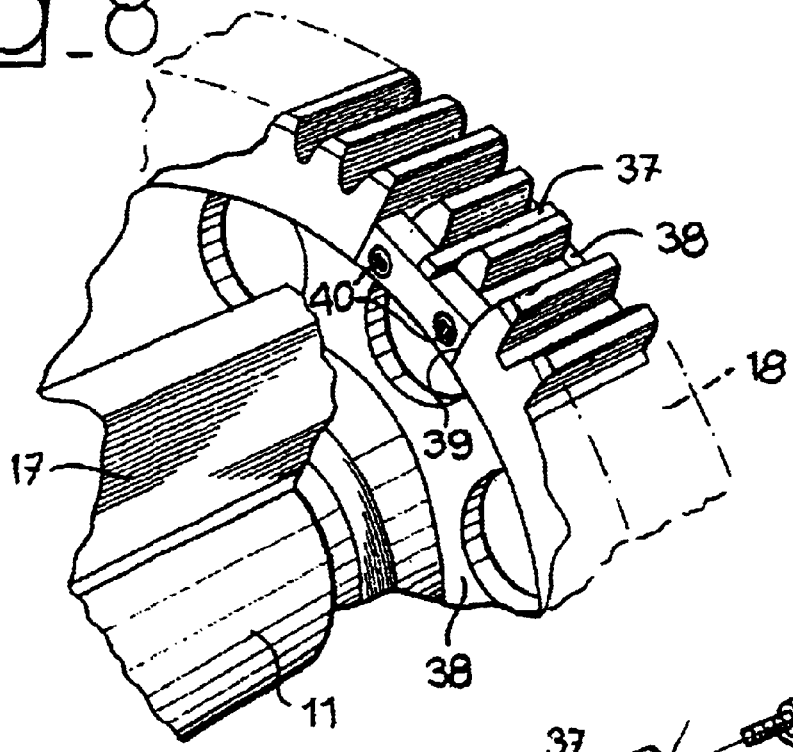
FIG. 8 is a perspective view of a part of FIG. 6
Figure 9:
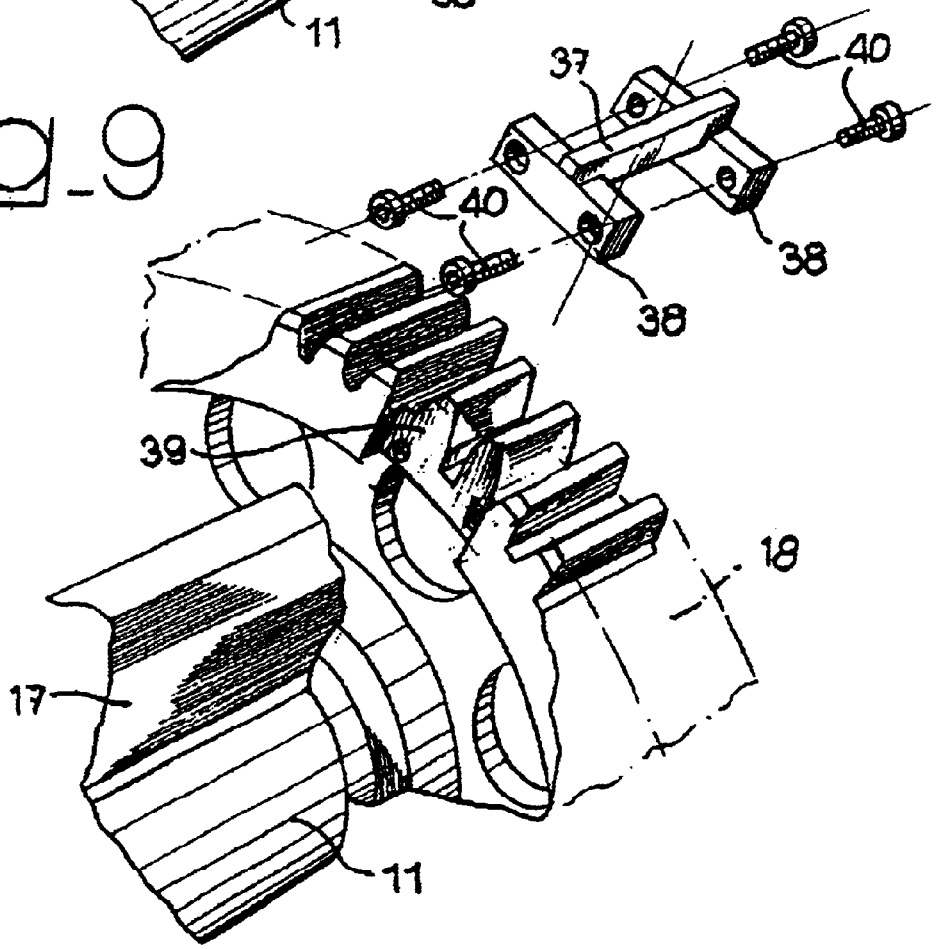
FIG. 9 is an exploded view of FIG. 8.

According to the fundamental feature of the invention, in correspondence of the above angular positioning the blade 16 is linearly displaced with respect to the counter blade 28 so as to penetrate with its cutting edge, in immediate proximity of the corresponding edge of the counter blade 28, into the cavity of the channel support 26. This displacement, upon which transverse cutting of the web N is carried out, is operated through the counter shaft 13 and the downward motion of the sliding blocks 20, against the action of the respective springs 22. To such effect each pair of meshing gears 18,31 is operatively associated to a respective cam system, shown in detail in FIGS. 6 through 9. This cam system simply comprises a shim or bar member 37 fitted within the space between two adjacent teeth of the corresponding gear 18, in an immediately proximal angular position to the counterweight 17 of the shaft 11, i.e. at an almost diametrically opposite position with respect to the blade 16. As shown in detail in FIGS. 8 and 9, the shim member 37 is secured to a pair of mounting plates 38 fitted within corresponding opposite recesses 39 of the gear 18 and fixed to the latter by means of axial screws 40.

Figure 6:
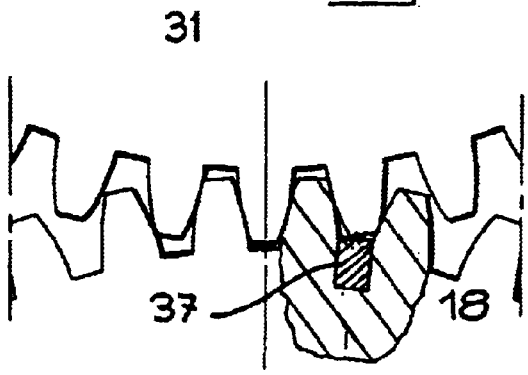
FIG. 6 is an enlarged partially sectioned view of a second detail of FIG. 4, shown in a first operating condition.

In operation, the gears 18 and 31 are regularly meshing with one another until the shim members 37 of the gears 18 reach the angular meshing position with the gears 31 (FIG. 6). Starting from this condition, corresponding to the position in which the blade 16 is facing towards the counter blade 28 (FIG. 5), meshing of the gears 18 with respect to the gears 31 takes place irregularly owing to the presence of the shim members 37, thus performing downward displacement of the gears 18, and thus of the whole shaft 11 against the action of the return springs 22, and consequently partial penetration of the blade 16 into the cavity of the channel support 26 of the counter blade 28. By virtue of this displacement the web N is cut by a shearing action between the blade 16 and the counter blade 28, in a sharp and precise way. While rotation proceeds, the shim members 37 are disengaged from the gears 31, whereby the gears 18 and thus the shaft 11 as a whole can be moved back to the previous raised position, due to the thrust action of the return springs 22.

As already pointed out the horizontal path F of the web N, which is generally tangential to the jacket 24 carried by the shaft 12, is not deflected or deviated appreciably during the cutting operation, whereby the web N is not tensioned or stretched upon cutting. This ensures achievement of best results in terms of cutting precision, repeatability and uniformity.

Naturally the details of construction and the embodiments may be widely varied with respect to what has been disclosed and illustrated, without thereby departing from the scope of the present invention such as defined in the appended claims. Thus for example, and as already pointed out in the above, the rotary cutting assembly 7 may be designed to perform a cut oriented obliquely instead of perpendicularly to the longitudinal edges of the web N, providing that mounting thereof enables its angular shifting with respect to the web N for instance between 0° and 45°.

What is claimed is:

1. A cutter for cross cutting a reeled web, comprising:

a web advancement assembly for advancing the reeled web along an advancement path;

a first shaft disposed at a first side of the advancement path, the first shaft being rotatable about a first axis;

a blade disposed on the first shaft;

a first gear and a second gear disposed at opposite ends of the first shaft and rotatable with the first shaft;

a second shaft disposed at a second side of the advancement path, the second side being opposite the first side, the second shaft being rotatable about a second axis;

a cylindrical jacket disposed on the second shaft;

a channel portion disposed on the cylindrical jacket;

a counter blade disposed at the channel portion;

a driving means for rotating the first shaft about the first axis and the second shaft about the second axis, the rotating of the first shaft and the rotating of the second shaft being synchronized with the advancing of the reeled web so as to position the blade and the counter blade opposite one another in a cutting position; and an actuating means for moving the first shaft toward the second shaft when the blade and the counter blade are in the cutting position such that the blade is received in the channel portion proximate the counter blade to cross cut the reeled web;

wherein the actuating means comprises:

a protrusion extending from at least one of the first and second gears; and a third shaft including a third gear and a fourth gear disposed at opposite ends of the third shaft, the first and second gears being meshingly engaged with the third and fourth gears, respectively, such that the third shaft rotates upon rotation of the first shaft;

wherein the protrusion contacts the third or fourth gear at the cutting position and displaces the first shaft in a direction toward the second shaft.

2. The cutter according to claim 1, wherein the cylindrical jacket includes an axial slot, the channel portion being disposed at the slot.

3. The cutter according to claim 2, wherein the cylindrical jacket has a circular cross-section and wherein the advancement path is tangential to the cylindrical jacket.

4. The cutter according to claim 1, wherein the first shaft is a cylindrical member having a circular cross-section, the blade is disposed on the cylindrical member, and the protrusion is disposed on the first gear in a position generally opposite the blade.

5. The cutter according to claim 1, further comprising a resilient return means which returns the first shaft to an original position after the first shaft is displaced.

6. The cutter according to claim 5, wherein the resilient return means comprises a spring.

7. The cutter according to claim 1, further comprising:

a bearing structure rotatably supporting the first and second shafts at ends of the first and second shafts; and a guide formed in the bearing structure for guiding the first shaft toward the second shaft such the first rotation axis approaches the second rotation axis; wherein the third shaft is rotatably supported by the bearing structure parallel to the first shaft and disposed on a side of the first shaft opposite the second shaft.

8. The cutter according to claim 7, further comprising a sliding block rotatably supporting the ends of the first shaft and being vertically displaceable along the guide.

9. The cutter according to claim 1, wherein the blade extends along a length of the first shaft between the first gear and the second gear, and wherein the second shaft is disposed parallel to the first shaft, the channel portion and the counter blade extending along a length of the second shaft.

10. A cutter for cross cutting a reeled web, comprising:

a web advancement assembly for advancing the reeled web along an advancement path;

a first shaft disposed at a first side of the advancement path, the first shaft being rotatable about a first axis;

a blade disposed on the first shaft;

a first gear and a second gear disposed at opposite ends of the first shaft and rotatable with the first shaft;

a second shaft disposed at a second side of the advancement path, the second side being opposite the first side, the second shaft being rotatable about a second axis;

a cylindrical jacket disposed on the second shaft;

a channel portion disposed on the cylindrical jacket;

a counter blade disposed at the channel portion;

a driving means for rotating the first shaft about the first axis and the second shaft about the second axis, the rotating of the first shaft and the rotating of the second shaft being synchronized with the advancing of the reeled web so as to position the blade and the counter blade opposite one another in a cutting position; and an actuating means for moving the first shaft toward the second shaft when the blade and the counter blade are in the cutting position such that the blade is received in the channel portion proximate the counter blade to cross cut the reeled web;

wherein the blade extends along a length of the first shaft between the first gear and the second gear and the second shaft is disposed parallel to the first shaft, the channel portion and the counter blade extending along a length of the second shaft;

wherein the actuating means comprises a third shaft, a third gear and a fourth gear disposed at opposite ends of the third shaft, the third and fourth gears engagingly meshing with the first and second gears, respectively, and a protrusion extending from the first gear, the protrusion contacting the third gear at the cutting position and displacing the first shaft in a direction toward the second shaft.

11. The cutter according to claim 10, wherein the protrusion comprises a shim member disposed within a space between two adjacent teeth of the first gear.

* * * * *